US006688250B2

(12) United States Patent
Davies et al.

(10) Patent No.: US 6,688,250 B2
(45) Date of Patent: Feb. 10, 2004

(54) METHOD AND APPARATUS FOR REDUCING TENSION VARIATIONS IN MONO-COLUMN TLP SYSTEMS

(75) Inventors: Kent B. Davies, Houston, TX (US); Stephen E. Kibbee, Houston, TX (US); Richard B. Matten, Houston, TX (US)

(73) Assignee: Seahorse Equipment Corporation, Houston, TX (US)

( * ) Notice: Subject to any disclaimer, the term of this patent is extended or adjusted under 35 U.S.C. 154(b) by 0 days.

(21) Appl. No.: 09/923,193

(22) Filed: Aug. 6, 2001

(65) Prior Publication Data

US 2003/0024459 A1 Feb. 6, 2003

(51) Int. Cl.[7] ..... B63B 35/44
(52) U.S. Cl. ..... 114/264; 114/293
(58) Field of Search ..... 114/264, 293

(56) References Cited

U.S. PATENT DOCUMENTS 4,606,673 A 8/1986 Daniell
4,685,833 A 8/1987 Iwamoto
4,702,321 A 10/1987 Horton
5,507,598 A * 4/1996 Huete ..... 405/203
5,558,467 A 9/1996 Horton
5,833,397 A 11/1998 Horton, III
5,983,822 A 11/1999 Chow et al.
6,012,873 A * 1/2000 Copple et al. ..... 405/224
6,027,286 A 2/2000 Pollack

FOREIGN PATENT DOCUMENTS

WO WO 99/54198 10/1999

* cited by examiner

*Primary Examiner*—Jesus D. Sotelo
(74) *Attorney, Agent, or Firm*—Nick A. Nichols, Jr.

(57) ABSTRACT

A floating platform for recovery of oil and gas from offshore oil and gas fields supports one or more decks above the water surface to accommodate equipment for drilling and processing oil, gas and water recovered from the oil and gas field. The platform includes a central column having a portion substantially below the water surface, and including a portion which extends above the water surface. The central column includes a base node and a plurality of pontoons extending outwardly therefrom and is anchored to the seabed by one or more tendons secured to the pontoons and to the seabed. Ballast modules fixedly or removably secured to the base node and/or the pontoons accept solid or liquid ballast for lowering the vertical center of gravity of the platform.

16 Claims, 6 Drawing Sheets

METHOD AND APPARATUS FOR REDUCING TENSION VARIATIONS IN MONO-COLUMN TLP SYSTEMS

BACKGROUND OF THE DISCLOSURE

The present invention relates generally to floating platform systems adapted for the exploitation of hydrocarbon formations found in offshore waters. More particularly, the invention relates to mono-column tension leg platforms (TLP) for recovery of deep sea hydrocarbon reserves.

The exploration for oil and gas deposits in offshore waters, and recovery of the oil and gas therefrom, is very expensive. As the water depth increases, the cost of exploration and production increases dramatically. Large capital expenditures are required to develop deepwater fields and thus only large and prolific oil and gas deposits can be profitably developed. Smaller oil and gas deposits usually do not justify large capital investments and therefore are deemed to be uneconomical to produce. There continues to be a need, therefore, for improved platform and drilling systems, particularly for use in deep waters, which would justify the economic investment to produce relatively small oil and gas fields.

Drilling and production platforms, such as TLP platforms, have heretofore been used to drill and produce deep water hydrocarbon formations. A TLP typically comprises a floating platform anchored to foundation members embedded in the seabed. Tension legs or tendons secure the TLP to the foundation members. The tendons are maintained in tension at all times by maintaining the buoyancy of the TLP significantly above the maximum TLP payload requirements under all environmental conditions.

A subcategory of TLP platforms, known as a mono-column TLP, has been developed to reduce costs and permit the economic development of smaller deepwater deposits of oil and gas. Mono-column TLP platforms are characterized by a single surface-piercing buoyant column with three or more pontoons extending radially outward from the single buoyant column to increase tendon spacing and effectiveness.

The upper portion of the mono-column TLP extends above the water surface and is subjected to forces developed by the wind. The lower portion of the TLP extending below the water surface is subjected to forces exerted by waves and current. The tendons secure the mono-column TLP to the seabed and effectively eliminate heave, pitch and roll motions. The tendons therefore suffer variations in tendon forces which cause tendon fatigue, and in severe cases, could lead to failure of a tendon. Very large tendon force variations during severe storms can slack tendons and lead to snap loads that could also cause tendon failure. Consequently, tendon design is driven by these force variations. In deep water, large tendon force variations can dramatically increase tendon system cost by leading to increases in tendon diameter, wall thickness, material properties, and connector size.

It is therefore an object of the present invention to provide a floating platform system which reduces the magnitude of force variations in the tendon system and therefore reduces the overall cost of the floating platform system to be installed in very deep water, where tendon system cost is a large component of overall floating platform system cost.

SUMMARY OF THE INVENTION

The present invention provides a mono-column TLP system for recovery of oil and gas from offshore oil and gas fields. The platform supports one or more decks above the water surface to accommodate equipment for drilling and/or processing oil, gas and water recovered from the oil and gas field. In a preferred embodiment, the platform includes a central column having a portion substantially below the water surface, and including a portion which extends above the water surface. The central column includes a base and is anchored to the seabed by one or more tendons secured to the base of the central column and to the seabed. The floating platform includes a ballast system which adjusts tendon pretension and adjusts the vertical center of gravity and mass of the platform system.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION OF A PREFERRED EMBODIMENT

Figure 1:
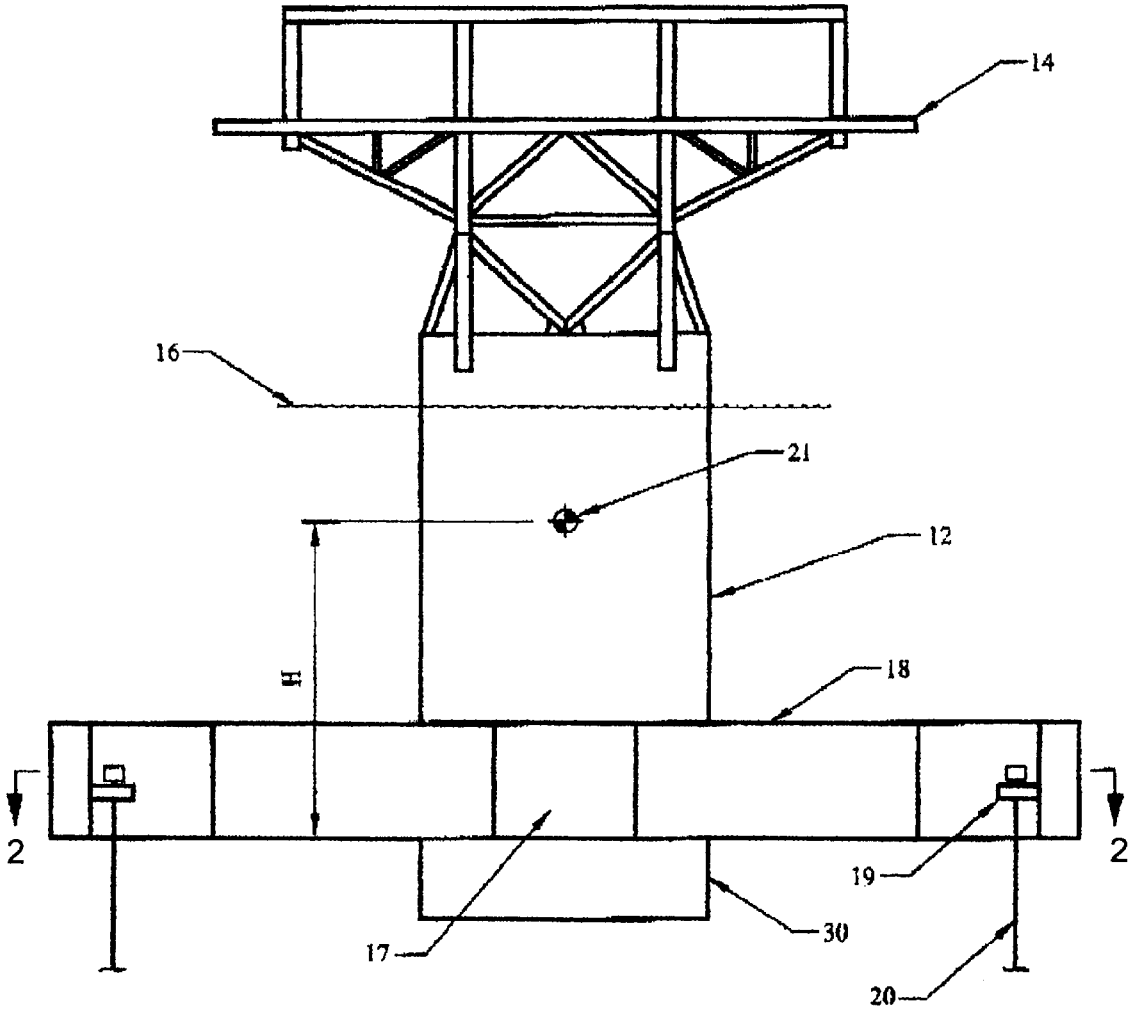
FIG. 1 is an elevation view of the floating platform of the invention depicting the shape of the main components of the platform hull.

Referring first to FIG. 1, the floating platform of the invention is generally identified by the reference numeral 10. The platform 10 includes a hull 12 which provides positive buoyancy and vertical support for the platform 10. The hull 12 includes a central column which supports one or more decks 14 at the upper end thereof above the water surface 16. Equipment necessary for the recovery and processing of oil, gas and water recovered from the oil and gas field are secured on the deck 14. The deck 14 can also supports equipment needed to perform drilling and/or completion operations.

The lower end of the central column of the hull 12 is secured to a base which comprises a base node 17 and pontoons 18 extending radially outward from the base node 17. The platform 10 is anchored to the seabed by tendons 20 secured to the pontoons 18 and to foundation piles (not shown in the drawings) embedded in the seabed. Tendon porches 19 extending outwardly from the pontoons 18 at the distal ends thereof support a connector assembly for securing the tendons 20 to the platform 10. The submerged volume of the platform (i.e. the pontoons 18, the base node 17, and the portion of the central column 12 below the waterline 16) provides sufficient buoyancy to support the payload of the platform 10, which payload includes the deck 14, drilling and/or completion equipment, production facilities, production and drilling risers and sufficient excess buoyancy to develop the tendon pre-tension.

The central column 12 of the platform 10 may extend approximately one hundred feet below the water surface 16 where it is subjected to variable wave motions which would cause heave, pitch and roll if the platform 10 were freely floating without tendons 20 anchoring it to the seabed. However, when tendons 20 are connected to the pontoons 18, the tendons 20 restrain the heave, pitch and roll of the platform 10. The magnitude of tendon force variations is increased by increases in height H of the vertical center of gravity (VCG) above the keel of the platform 10. In effect, the VCG height H, depicted in FIG. 1, acts as a lever arm that amplifies tendon force response to environmental loads. Therefore, a reduction in VCG height H reduces tendon force variations which are a primary cost driver of tendon cost for very deepwater TLP platforms.

Figure 2:
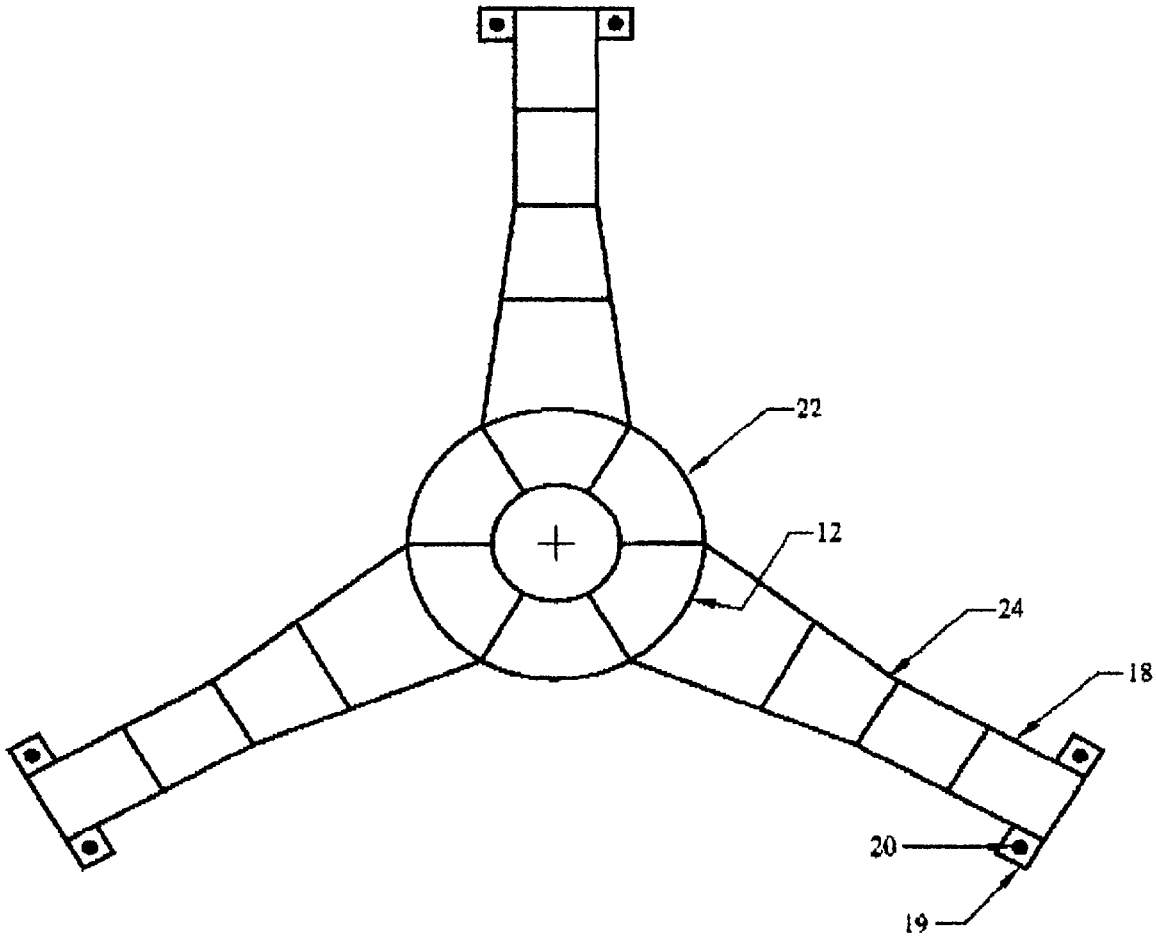
FIG. 2 is a section view of the floating platform of the invention taken along line 2—2 of FIG. 1.

Excessive tendon force variations may be ameliorated by lowering the height H of the vertical center of gravity 21 of the platform 10. To this end, the platform 10 of the invention is provided with a ballast system comprising seawater ballast or solid ballast. Permanent or temporary ballast may be located in ballast chambers located at any suitable position in the platform 10. For example, in FIG. 2 ballast chambers 22 and 24 are located in the base node 17 and the pontoons 18, respectively.

The platform 10 is provided with a lower ballast chamber 30 mounted below the base node 17. The ballast chamber 30 is a relatively short cylindrical chamber having an outside diameter approximately equal to the outside diameter of the central column 12. The ballast chamber 30 may be secured to the bottom of the base node 17 by welding or the like. The lower ballast chamber 30 is designed to be flooded with ambient seawater or alternatively the lower ballast chamber 30 may be designed to be watertight. If the ballast chamber 30 is watertight, it may be adapted to hold seawater ballast or solid ballast.

Figure 3:
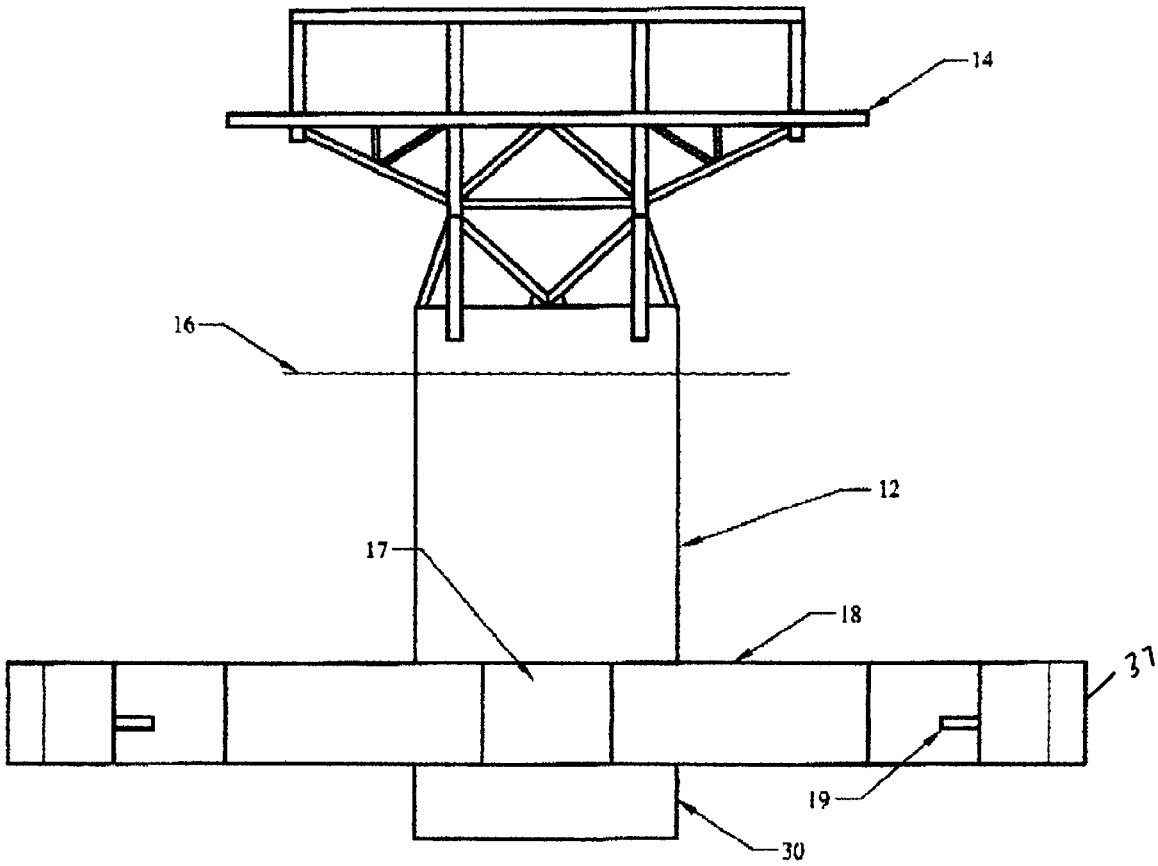
FIG. 3 is a partial side view of an alternate embodiment of the floating platform of the invention depicting ballast chambers located at the distal ends of the pontoons and below the base node of the platform of the invention.
Figure 4:
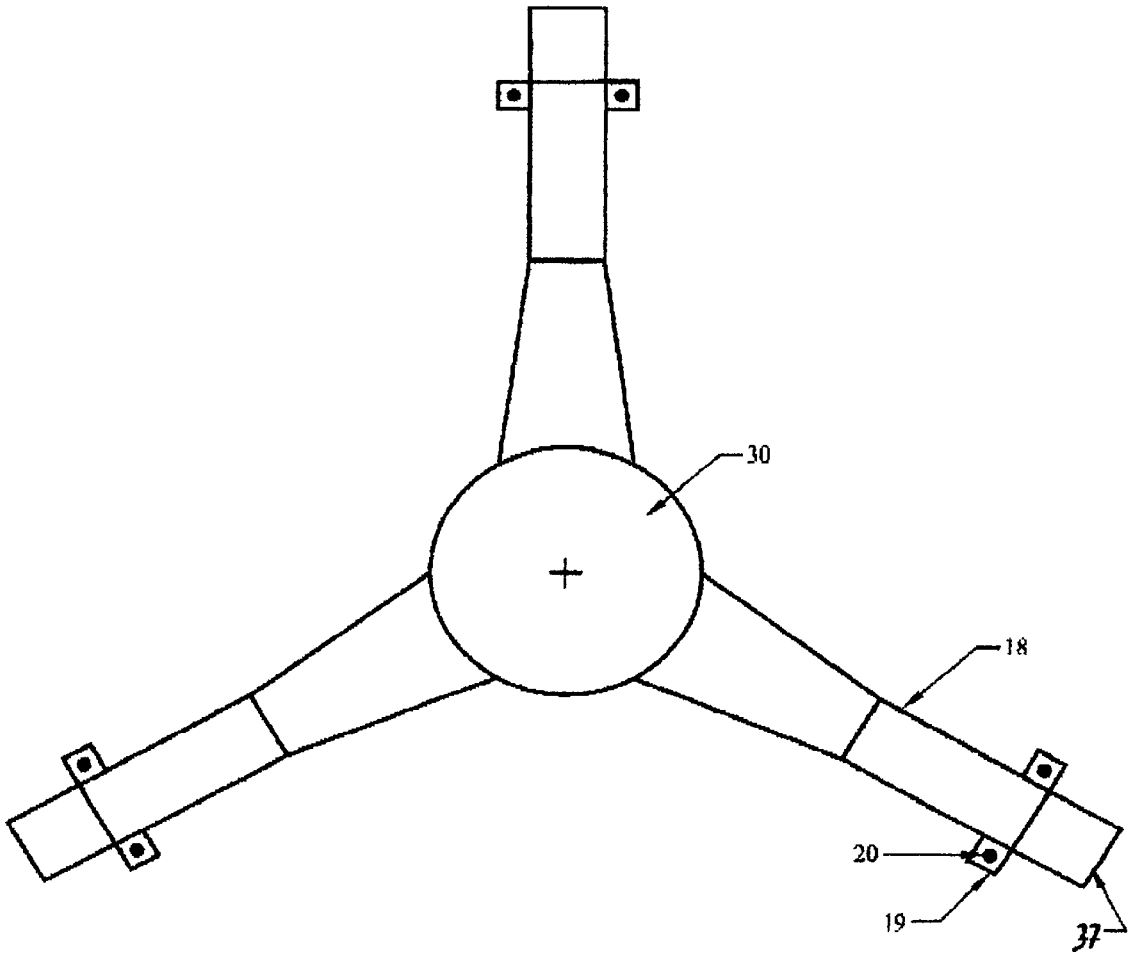
FIG. 4 is a bottom plan view of the floating platform of the invention shown in FIG. 3.
Figure 5:
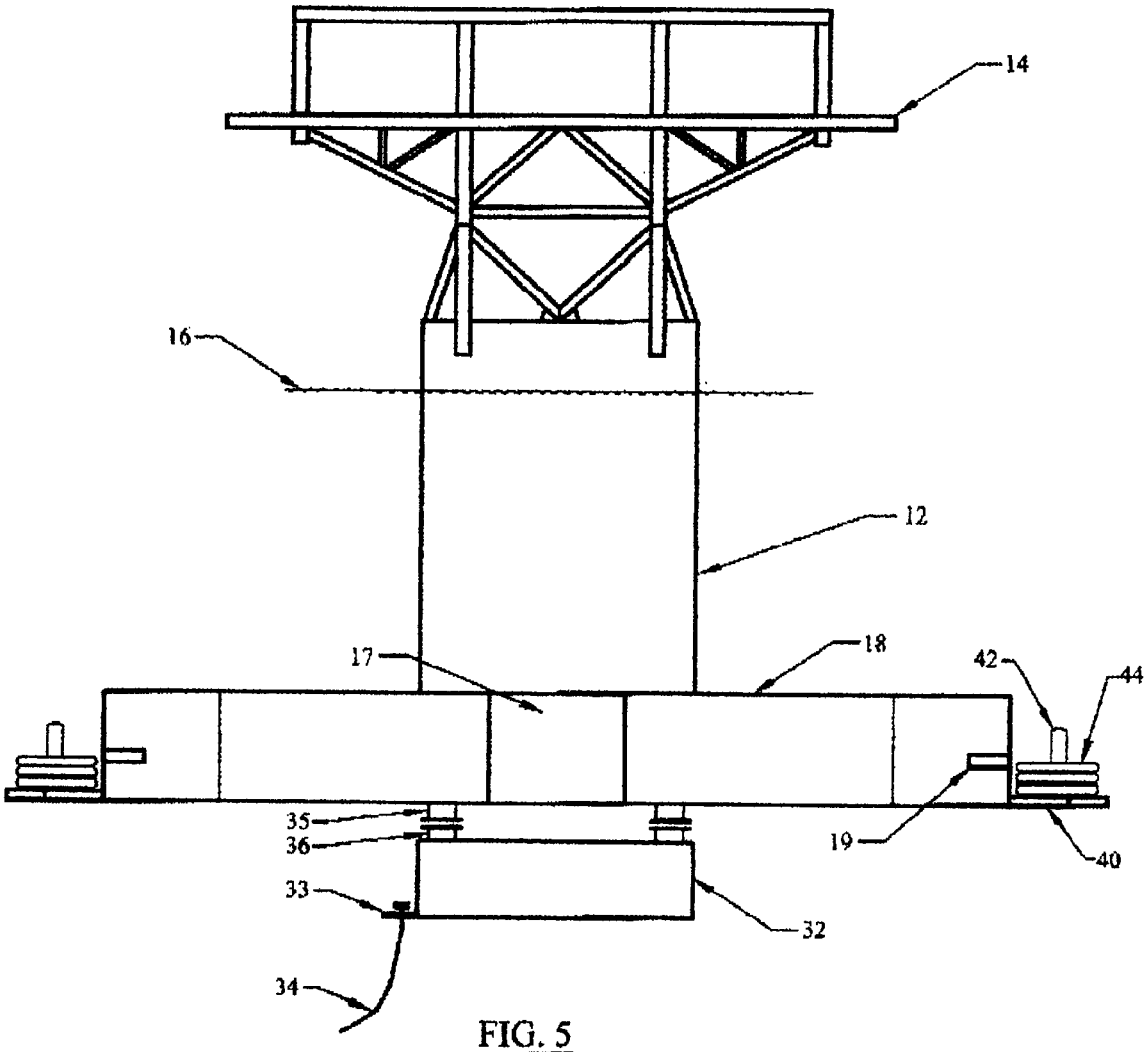
FIG. 5 is a partial side view of an alternate embodiment of the floating platform of the invention depicting removable ballast components located at the distal ends of the pontoons and below the base node of the platform of the invention.
Figure 6:
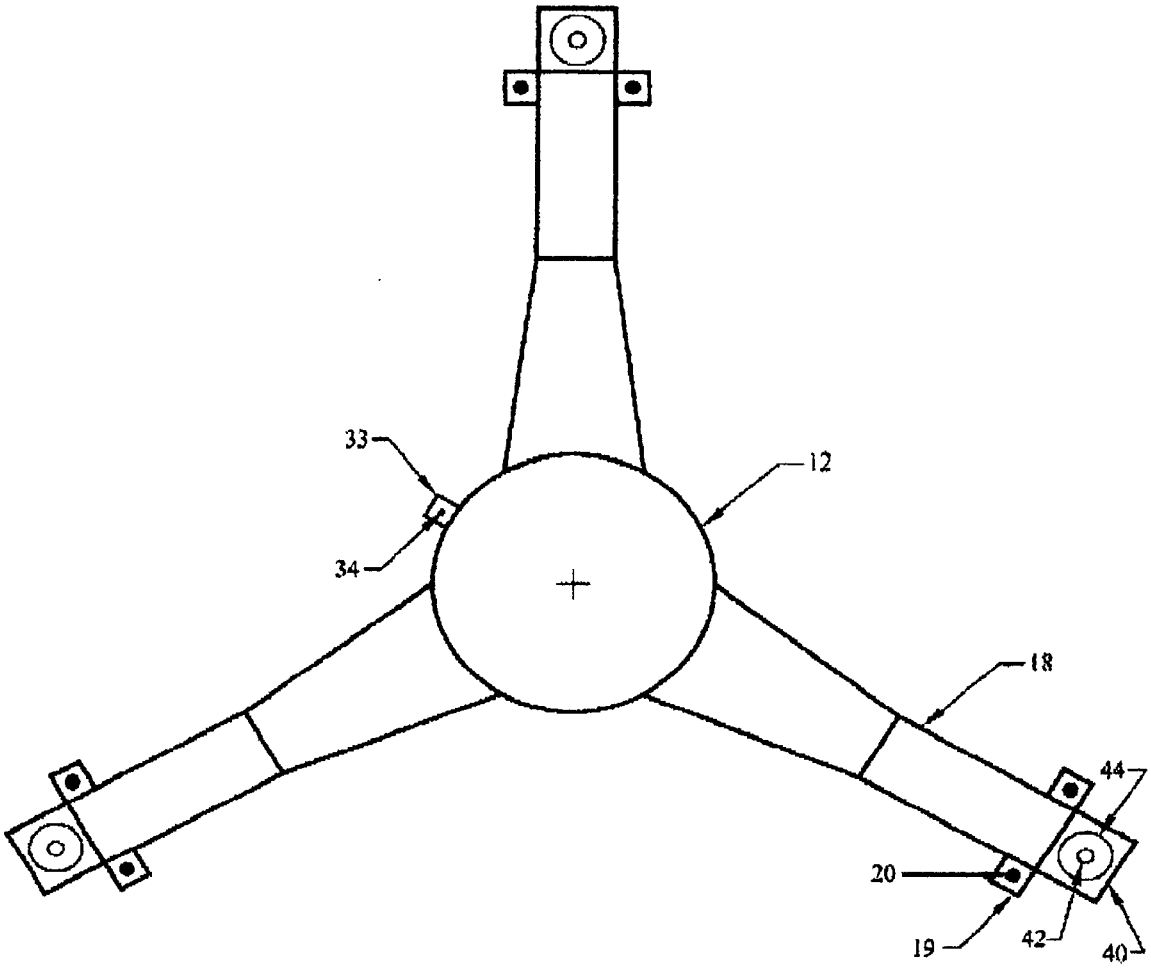
FIG. 6 is a top plan view of the floating platform of the invention shown in FIG. 5.

Referring now to FIG. 5 an alternate embodiment of the invention depicts a ballast module 32 mounted to the bottom of the base node 17. In the embodiment of FIG. 5 the ballast module 32 is added to the offshore platform 10 to lower its VCG 21. The ballast module 32, like the ballast chamber 30 shown in FIG. 3, is a substantially cylindrical chamber having a diameter approximately equal to the diameter of the central column 12. Mounting posts 35 secure the ballast module 32 to the base node 17. The mounting posts 35 may be welded or otherwise fixed to the base node 17 and module 32. Ballast module 32 may be designed to be flooded with seawater or alternatively the ballast module 32 may be designed to be watertight. In either case, the module 32 is designed to receive either seawater or solid ballast.

Referring still to FIG. 5, the mounting posts 35 may be pre-installed about the periphery of the base node 17, by welding or other connection means, so that the ballast module 32 may be installed at a later time, after the platform 10 is installed offshore. In such an embodiment, the ballast module 32 is likewise provided with mounting posts 36 for cooperating engagement with the posts 35 mounted on the base node 17. Various connections means, such as grout, mechanical connectors or welding, may be employed to lock the posts 35 and 36 together and thus secure the ballast module 32 to the base node 17. This manner of connection has the added benefit of permitting the module 32 to be detached from the hull 12 in the event the requirements of the platform 10 change and the ballast module 32 is no longer needed or to substitute a larger or smaller ballast module in the event greater or lesser ballast is required. In the event seawater ballast is utilized in the platform 10 of the invention, the ballast chamber 30 and ballast module 32 are provided with the necessary plumbing (not shown in the drawings), including a fill line and vent line, for connection with the ballast system of the platform 10.

In FIGS. 3–6, the shape of the ballast chamber 30 and ballast module 32 is depicted as a closed cylinder or plug for illustrative purposes. It is understood that the ballast chamber 30 or ballast module 32 may comprise various shapes. If, for example, the hull 12 includes a moon pool, the ballast chamber 30 or ballast module 32 is provided with an axial passage for matching alignment with the profile of the moon pool. The ballast chamber 30 or ballast module 32 in such an arrangement would have a shape similar to that of a donut. Likewise, the ballast chamber 30 and ballast module 32 may include radial extensions or arms matching the profile of the pontoons 18, which arms may be secured to the bottom sides of the pontoons 18. Additional riser hangers, such as porches 33, for hanging risers or flow lines 34 therefrom, as shown in FIG. 5, may be installed on the ballast chamber 30 or ballast module 32, as required.

Referring again to FIGS. 3 and 4, an alternate embodiment of the invention depicts ballast chambers located in outer tanks 37 which are extensions of the pontoons 18 beyond the tendon porches 19. The outer tanks 37 may be part of the initial platform construction or may later be added after offshore installation of platform 10 via connecting means in accordance with platform operational and design needs as may change over time. The benefit of locating either solid or liquid ballast in the outer tanks 37 is that the ballast weight is both low and structurally efficient.

Referring again to FIGS. 5 and 6, an alternate embodiment of the invention shows a ballast porch 40 and ballast post 42 adapted to receive solid liftable ballast weights 44 fixed to the distal ends of the pontoons 18. The ballast weights 44 may be installed before or after the platform 10 is put into service. The several ballast weights 44 at the end of each pontoon 18 allow ballast to be added gradually in a manner that does not cause an unacceptable imbalance in the tension in each tendon 20.

While a preferred embodiment of the invention has been shown and described, other and further embodiments of the invention may be devised without departing from the basic scope thereof, and the scope thereof is determined by the claims which follow.

What is claimed is:

1. A floating platform having a central column, supporting one or more decks in a body of water above the water line and anchor means securing the platform to the seabed below the water line, wherein the central column includes a base node and a plurality of pontoons extending radially outwardly therefrom, the improvement comprising ballast means secured to the base node of said central column for lowering the vertical center of gravity of the floating platform.

2. The platform of claim 1 wherein said ballast means includes a ballast module mounted on said base node of said central column and depending downwardly from said base node.

3. The platform of claim 2 including one or more connectors mounted on the periphery of said base node and said ballast module for securing said ballast module below said base node.

4. The platform of claim 3 wherein said connectors include cooperative latch means for releasably attaching said ballast module to said base node.

5. The platform of claim 2 wherein said ballast means includes ballast tanks secured to the distal ends of said pontoons.

6. The platform of claim 2 wherein said ballast means includes ballast weights removably mounted adjacent the distal ends of said pontoons.

7. The platform of claim 6 wherein said ballast weights are supported on ballast porches fixedly secured to said pontoons and wherein said ballast porches extend outwardly from the distal ends of said pontoons.

8. The platform of claim 1 wherein said ballast means includes ballast tanks secured to the distal ends of said pontoons.

9. The platform of claim 1 wherein said ballast means includes ballast weights removably mounted adjacent the distal ends of said pontoons.

10. The platform of claim 9 wherein said ballast weight are supported on ballast porches fixedly secured to said pontoons and wherein said ballast porches extend outwardly from the distal ends of said pontoons.

11. A method of lowering the vertical center of gravity of a floating platform, wherein the floating platform includes a central column supporting one or more decks in a body of water above the water line and anchor means sec-wing the platform to the seabed below the water line, and wherein the central column includes a base node and a plurality of pontoons extending radially outwardly therefrom, the method including the step of securing a ballast module to said base node of said floating platform, wherein said ballast module depends downwardly from said base node.

12. The method of claim 11 including the step of releasably attaching said ballast module to said base node.

13. The method of claim 11 including the step of securing ballast tanks on the distal ends of said pontoons.

14. The method of claim 11 including the step of removably mounting ballast weights adjacent the distal ends of said pontoons.

15. The method of claim 14 including the step of supporting said ballast weights on ballast porches fixedly secured to and extending outwardly from the distal ends of said pontoons.

16. A floating platform having a central column supporting one or more decks in a body of water above the water line and anchor means securing the platform to the seabed below the waterline, wherein the central column includes a base node and a plurality of pontoons extending radially outwardly therefrom, the improvement comprising ballast means releasably secured to the base node of said central column for stabilizing said floating platform.

* * * * *